United States Patent [19]

Stimson

[11] Patent Number: 4,490,413

[45] Date of Patent: Dec. 25, 1984

[54] METHOD FOR PRODUCING A PAINTING

[76] Inventor: Frank P. Stimson, 860 20th St., Knoxville, Tenn. 37915

[21] Appl. No.: 580,531

[22] Filed: Feb. 15, 1984

[51] Int. Cl.[3] ..... B05D 5/06; B05D 1/20

[52] U.S. Cl. ..... 427/262; 427/263; 427/280; 427/281; 427/442

[58] Field of Search ..... 427/268, 281, 434.3, 427/263, 262, 267, 280, 442; 8/486; 118/402, 403

[56] References Cited

U.S. PATENT DOCUMENTS

| | | | |
|---|---|---|---|
| 304,802 | 9/1884 | Dewar | 427/268 |
| 1,668,934 | 5/1928 | Bracewell | 8/483 |
| 1,846,845 | 2/1932 | Clark | 8/486 |
| 1,871,920 | 8/1932 | Senior | 8/486 |
| 1,931,667 | 10/1933 | Loetscher | 427/268 |
| 2,127,595 | 8/1938 | Heden | 118/402 |
| 4,091,126 | 5/1978 | Hidan | 427/262 |

*Primary Examiner*—Evan K. Lawrence
*Attorney, Agent, or Firm*—Luedeka & Neely

[57] ABSTRACT

A method for producing a painting using a flotation process in which a floating elongate member is placed in a shallow pan of water and one or more oil based litho inks having different viscosities are placed on the surface of the water within the closed shape of the elongate member. Using an external force such as an air stream, the litho ink is formed into a desired pattern on the surface of the water and it is allowed to float undisturbed by external forces for a time lapse of about six to fourteen hours to form a textured pattern having finer and more textured paint globules than when the paint was first blown into a desired pattern. The paint pattern is lifted off of the surface of the water and onto a flexible sheet, and after the paint is at least partially dried, artists non-oil base ink is applied to the flexible sheet within the closed shape of the painting to areas of the sheet on which paint is not present. A sufficient quantity of ink is used to flow the ink to the edge of the oil pattern and to stop the ink substantially without flowing ink onto the oil pattern.

5 Claims, 12 Drawing Figures

METHOD FOR PRODUCING A PAINTING

The present invention relates to flotation imprinting processes for making a painting and particularly relates to a flotation process utilizing a time lapse to achieve a desired texture and globule characteristics in an oil ink pattern and using an ink flow technique to finish the painting.

Flotation and printing processes for making a marble-like print on building materials is well known. In such known processes, a marbled or grain print is achieved by floating oil ink on water, blowing or disturbing the ink to form a pattern, and then imprinting the building product with the pattern. In this manner, imitation marble or wood finishes on building materials are achieved.

In the present invention, a painting is produced by a water flotation process, and a work of art is produced rather than a marble or wood finish. Although the technique of producing the painting somewhat resembles the flotation processes used to imprint building materials, the method of the present invention is significantly different from known processes and results in a strikingly different end result. In accordance with the present invention, a painting is produced using oil based litho ink, artists non-oil based ink, a shallow pan, water, an air stream and a flexible sheet. Preferably, the flexible sheet is a material generally known as "bridal satin" that is made from 100% acetate. The shallow pan is partially filled with water and a floating elongate member is formed into a desired closed shape and is placed on the surface of the water in the pan. One or more oil colors are introduced on the surface of the water within the elongate member. If two or more litho ink colors are used, each color has a different viscosity. Next, a stream of air is directed in a desired pattern onto the surface of the water and the oil based litho ink is blown into a desired pattern. During this process, the elongate member confines and defines the outermost distribution of the colors. After the desired pattern is achieved, the litho ink is allowed to float undisturbed by external forces on the surface of the water for a desired time lapse of about six to fourteen hours. In this manner, the ink forms into a more textured pattern and a finer more textural globule ink pattern is formed on the surface of the water. A flexible sheet in a limp condition is lowered onto the surface of the water over the ink with a central portion of the sheet being first lowered onto the water surface. The sheet is then lifted from the water surface and the oil ink pattern is lifted from the water onto the sheet. The ink pattern formed on the sheet corresponds to the ink pattern formed on the surface of the water, and the outermost edge of the ink pattern on the sheet corresponds to the closed shape of the elongate member.

The painting is allowed to at least partially dry and then a non-oil based artists ink is applied to the flexible sheet within the closed shape of the painting to areas of the sheet on which ink is not present. A sufficient quantity of ink is used to flow the ink to the edge of the pattern and to stop the ink substantially without flowing ink onto the oil litho ink pattern. The oil litho ink and artists ink are then allowed to dry to form an ink and oil painting in the closed shape of the elongate member.

In order to further enhance the globule pattern of the painting, a chemical such as N,N-diethyl-meta-toluamide, which is commonly sold as an insect repellent under the registered trademark "Off" (manufactured by S. C. Johnson & Son, Inc.) may be used to cause increased formation of globule patterns in the oil ink. Also, the method may be performed without using the elongate member or the inking step to achieve an oil pattern only on the sheet.

The present invention may best be understood by reference to the following Detailed Description of a preferred embodiment when taken in conjunction with the Drawings in which.

Figure 5:
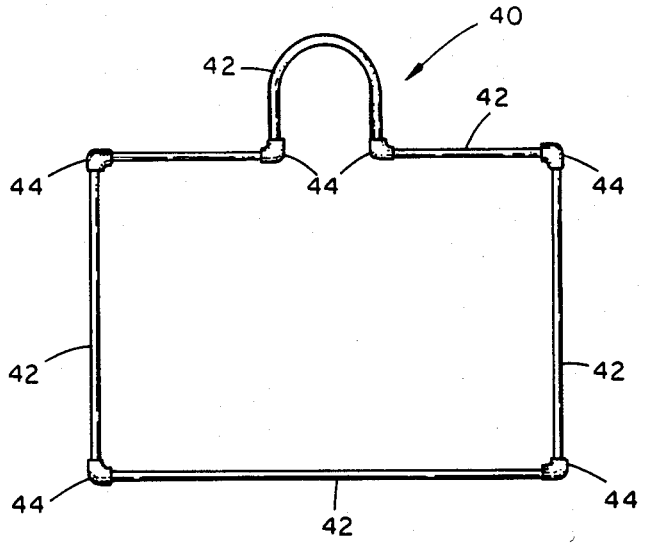
Figure 6:
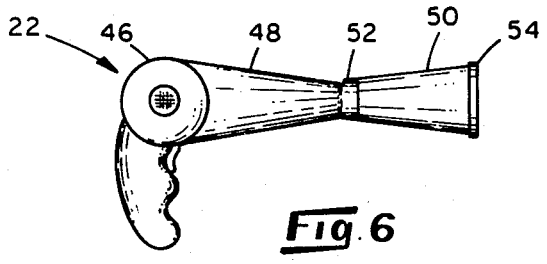
Figure 7:
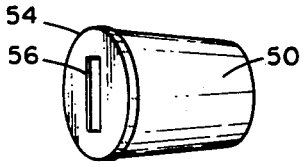
Figure 8:
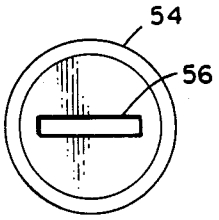
Figure 9:
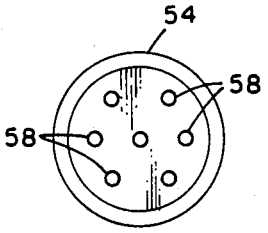
Figure 10:
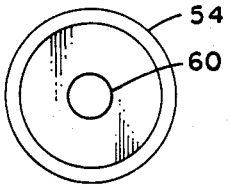
Figure 11:
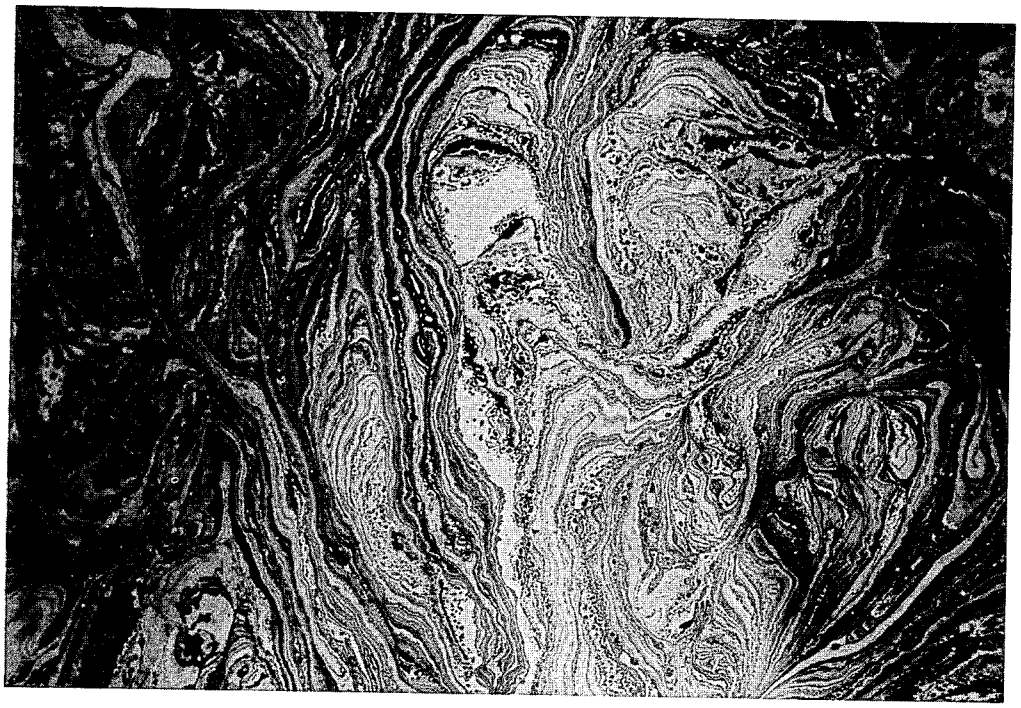
Figure 12:
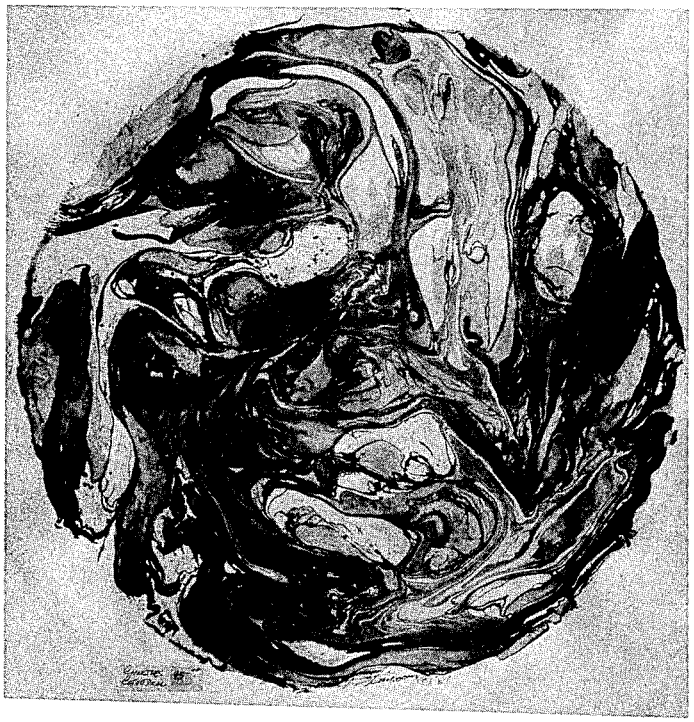

FIG. 5 discloses plastic tubing formed into a desired shape to be used as an elongate member on the surface of the water to confine the litho oil ink to the shape of the member;

FIG. 6 discloses an air blower and nozzle used in the present invention;

FIG. 7 is a perspective view of an air nozzle used in the present invention;

FIGS. 8, 9 and 10 are end views of air nozzles that are used in the present invention;

FIG. 11 is a photograph of a painting made using a time lapse of about ten (10) hours; and FIG. 12 is a photograph of painting made without a time lapse.

Figure 1:
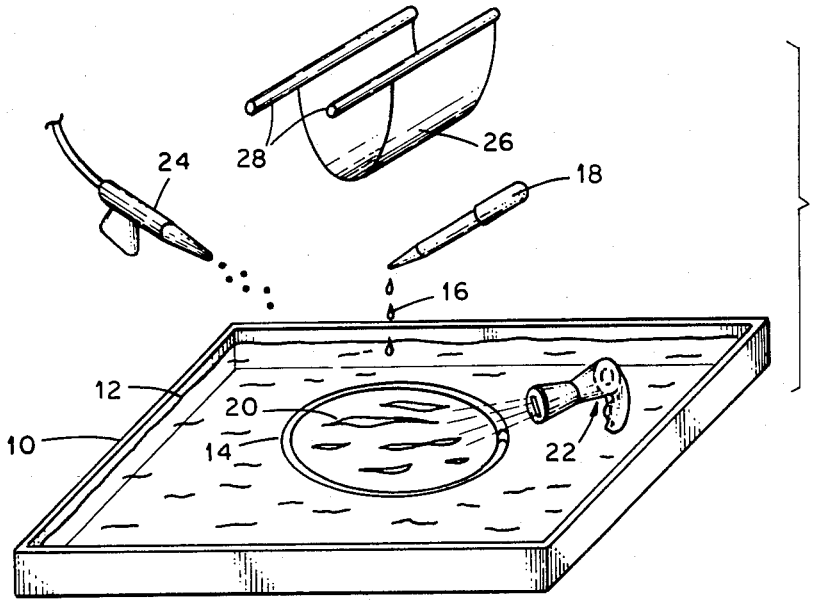
FIG. 1 is a somewhat diagrammatical perspective view of a shallow pan of water in which the litho oil flotation process will be performed.

Referring now to the drawings in which like reference characters designate like or corresponding parts throughout the several views, there is shown in FIG. 1 a perspective view of a shallow pan 10 in which the flotation process of the present invention is performed. The pan 10 may be any of a number of sizes, but the preferred pan is 43½ inches long by 33¾ inches wide by 2 inches deep and is constructed of structural foam. An aluminum pan having dimensions 32"×26"×3" is also suitable for use in the present invention. The pan 10 is approximately two-thirds filled with water to the water line 12, and an elongate member 14 is formed into a closed shape and is placed on the surface of the water. In the preferred embodiment, the elongate member 14 is a plastic tube that is formed into a ring with the ends of the ring being sealed together with an appropriate fitting or with tape. With the ring sealed in this manner, it will easily float on the surface of the water. Oil based litho ink 16 is introduced onto the surface of the water within the elongate member 14 using an eye dropper 18 or other appropriate instruments and the preferred ink 16 is known as IPI Speed King Litho Ink manufactured by Inmont Corporation of New York. Any number of litho oil base inks may be used, but if more than one color of litho oil ink is used in a particular painting, the two colors should be mixed with different amounts of turpentine or other thinner to achieve different viscosities. In this manner, the two inks will resist running together or mixing. For a two color painting in the shape of a circle with a thirty inch diameter, approximately fifteen milliliters of each color is a desirable amount of ink 16 to place on the water.

After the ink 16 has been placed on the water, an air stream from a blower 22 is used to form the ink 16 into a desired pattern 20 on the surface of the water within the elongate member 14. The elongate member 14 will confine and define the outermost edges of the distribution of the ink pattern 20. The type of air stream used to distribute the oil ink 16 in a desired pattern may vary depending upon the effect desired to be achieved by the artist.

After a desired pattern 20 has been achieved within the elongate member 14, the pattern is allowed to stand for a time lapse of about eight hours. The purpose of the time lapse is to give the painting a textured effect and to allow globules to form in the ink. When the ink is first distributed on the surface of the water, the edges of the ink floating on the water form smooth curving surfaces and the main body of the ink remains substantially intact. After the time lapse, a multitude of tiny ink globules have been formed in the ink and the edges of the ink pattern 20 become somewhat fuzzy and erratic so that a textured effect is achieved which gives the final painting an appearance of depth. It will be understood that the speed of globular formation and of texturizing will vary depending primarily upon ink viscosity and water temperature, but assuming room water temperature for most litho oil inks, the minimum time lapse necessary to achieve the globule and texturizing effect is about six hours, and the maximum time lapse is about fourteen hours. After about fourteen hours, the texturizing and globule forming effect will begin to destroy the pattern beyond recognition. For most inks, the optimum time lapse to achieve optimum texturizing and globular formation is about twelve hours. However, it should be understood that the time lapse factor is flexible and can be the segment of time when the artist feels that the painting has attained its zenith of interest and beauty. The variations in the length of time lapse is necessitated by the different chemical contents of different pigmentations in the ink and the different chemical and physical actions operating on the painting.

The affect created by the time lapse is difficult to describe and is best appreciated by direct viewing of the paintings. There is shown in FIG. 11 a photograph of a painting that was allowed to float for about ten hours on the water before it was lifted onto the satin. The photograph shown in FIG. 12 depicts a painting that was not allowed to float on the water for any substantial length of time.

To further enhance the globule forming effect, chemicals may be applied to the ink 16 as it floats on the water, such as by spraying chemicals onto the ink 16 using the air sprayer 24. The preferred chemical is N,N-diethyl-meta-toluamide, which is commonly found in the insect repellent "OFF" (registered trademark), but the following chemicals are also useful in enhancing the globular formation: K-Mart (trademark) Window Cleaner, Niagara (trademark) Spray Starch manufactured by CPC International, Inc., and "Complete" (trademark), manufactured by S. C. Johnson & Son, Inc.

Figure 2:
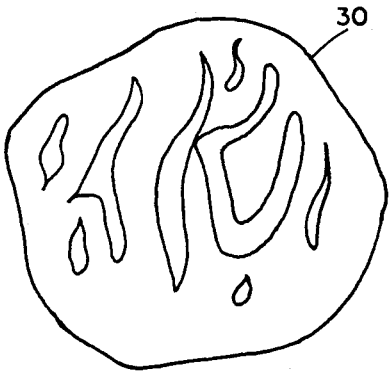
FIG. 2 is a detailed view of a portion of the litho oil ink pattern representing its appearance immediately after the desired pattern is created.
Figure 3:
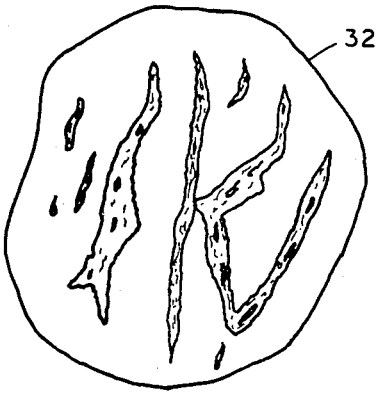
FIG. 3 is a detailed view of a portion of the litho oil ink pattern after a time lapse.

Referring now to FIGS. 2 and 3, there is shown in FIG. 2 a pattern 30 that is achieved immediately after the ink 16 has been applied to the water and blown. In FIG. 3, pattern 32 is the same as pattern 30 but is modified by the effects of the time lapse. Globules have formed throughout the pattern 32 and the edges of the main ink pattern 32 have become texturized or fuzzy. In FIGS. 2 and 3, the texturizing and globular effect has been exaggerated somewhat for the purposes of illustration only.

Referring again to FIG. 1, after the time lapse, a flexible sheet 26 is quickly lowered onto the surface of the water. The sheet 26 is preferably bridal satin manufactured by Celanese Corporation and is made from 100% acetate. Two opposing edges of the sheet 26 are attached to rigid rods 28 and the sheet 26 is lowered toward the surface of the water in a limp condition so that a central linear portion first engages the water. As the sheet 26 is lowered further, the rods 28 are moved apart gradually so that the sheet 26 lies flat on the water and no air pockets are formed as the sheet is lowered onto the water.

Figure 4:
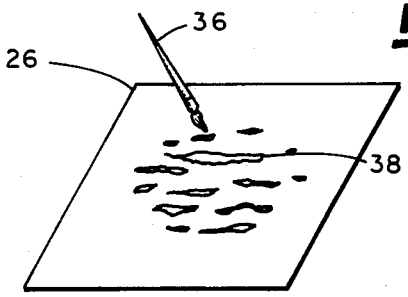
FIG. 4 is a somewhat diagrammatic view of the flexible sheet showing non-oil based ink being applied thereto using a brush.

When the sheet is removed from the water, the pattern 20 will be lifted from the water and a corresponding pattern is formed on the sheet 26. Referring to FIG. 4, the sheet 26 is shown with a pattern 38 formed thereon. The pattern 38 is allowed to at least partially dry and a non-oil based ink is applied to the sheet 26 within the pattern 38. Preferably Pelican or Higgins waterproof ink is used, and a sufficient quantity of ink is used so that when the brush touches the bridal satin, the ink will flow away from the brush, slightly, along the surface of the sheet. Using the brush 36, the ink is applied near, but not on, the litho oil ink of the pattern 38, and the ink will flow to the edge of the litho oil ink and stop. In this manner, the interior sections of the pattern 38 may be quickly and easily inked to achieve the desired painting without painting over the litho oil ink pattern 38 that is already on the sheet 26.

In FIG. 5, another elongate member is shown formed into another closed shape to illustrate that many closed shapes are suitable for use in the invention. In this instance, the closed shape is formed by plastic tubing 42 and U-joints 44. The plastic tubing and U-joints are formed into a generally rectangular shape with a semicircular projection. This type of elongate member formed into a closed shape may be used in substitution for the ring 14 discussed above.

Referring now to FIG. 6, there is shown a detailed view of the blower 22 used to form a desired pattern in the litho oil ink on the water surface. The blower 22 includes a fan 46, an output conduit 48 and a nozzle 50. The nozzle 50 has a truncated conical shape with the smaller end of the nozzle 50 fitting over the conduit 48 at the position 52. Preferably, the nozzle 52 fits over the conduit 48 and is held there by a friction fit. However, the nozzle 52 may be attached to the conduit 48 by any conventional means.

The nozzle 50 also includes a removable cap 54 that finally shapes the air stream as it leaves the nozzle 50. As best shown in FIGS. 7 and 8, the cap 54 may have an aperture 56 in the shape of an elongate rectangle. This cap is used to form a widely dispersed planar air stream. If a different air stream pattern is desired, the cap 54 may be removed and another cap placed on the nozzle 50 in its place. Two alternate caps are shown in FIGS. 9 and 10. In FIG. 9, the cap 54 has a plurality of small apertures 58 spread about the surface of the cap. This cap will form a widely dispersed non-planar air stream. In FIG. 10, the cap 50 is shown with a central aperture 60. This aperture will form a more concentrated stream of air having a generally higher velocity than the caps having the rectangular aperture 54 or the dispersed apertures 58. In doing the actual design with air many different apertures and air velocities are used.

What is claimed is:

1. A method for producing a painting using printers litho oil ink, a shallow pan, water, and a flexible sheet comprising:

partially filling the shallow pan with water;

introducing a litho oil ink onto the surface of the water, said ink being capable of forming globules when contacting said surface;

forming a desired pattern in the litho oil ink as it floats on the surface of the water;

allowing the litho oil ink to float undisturbed by external forces on the surface of the water for a time lapse such that the ink has formed into a desired globule pattern, whereby the ink forms a pattern on the water having a textured appearance of depth;

after the time lapse, lowering the flexible sheet in a limp condition onto the surface of the water over the ink with a central portion of the sheet being first lowered onto the water surface; and lifting the flexible sheet from the water to lift the litho oil ink pattern from the water onto the sheet corresponding to the pattern previously formed on the water's surface.

2. A method for producing a painting using printers litho oil ink, non-oil based ink, a shallow pan, water, and a flexible sheet, comprising:

partially filling the shallow pan with water;

forming a floating elongate member into a desired closed shape;

floating the elongate member in the desired closed shape on the water in the shallow pan;

introducing a first litho oil ink onto the surface of the water within the elongate member in the desired closed shape, said ink being capable of forming globules when contacting said surface;

forming a desired ink pattern on the surface of the water within the elongate member with the elongate member confining and defining the outermost distribution of the ink so that the ink is distributed within the closed shape of the elongate member;

allowing the ink to float on the water undisturbed by external forces for a time lapse of about six to fourteen hours until the ink has formed into a desired globule pattern, whereby the ink forms a pattern on the water having a textured appearance of depth;

after the time lapse, lowering the flexible sheet in a limp condition directly over the elongate member onto the surface of the water over the ink with a central portion of the sheet being first lowered onto the water's surface;

lifting the flexible sheet from the water surface to lift the litho oil ink pattern from the water onto the flexible sheet corresponding to the pattern formed in the ink when it was floating on the water surface, the outermost edge of the litho oil ink pattern on the sheet having the closed shape of the elongate member;

applying non-oil based ink to the flexible sheet within the closed shape of the ink pattern to areas of the sheet on which ink is not present and using a sufficient quantity of ink to flow the ink to the edge of the oil pattern and stop the ink substantially without flowing ink onto the litho oil ink pattern; and allowing the non-oil based ink and litho oil ink to dry to form a painting having a shape corresponding to the closed shape of the elongate member.

3. The method of claim 2 further comprising, after introducing the litho oil ink onto the water, spraying a liquid onto the ink floating on the surface of the water to form further globule patterns in the ink.

4. The method of claim 3 wherein said liquid is N, N-diethyl-meta-toluamide.

5. A method for producing a litho oil painting using litho oil ink, non-oil based ink, a shallow pan, water, an air stream, and a flexible sheet, comprising:

partially filling the shallow pan with water;

forming an elongate member into a desired closed shape;

floating the elongate member on the water in the shallow pan;

introducing a first litho oil ink having a first viscosity onto the surface of the water within the elongate member;

introducing at least a second litho oil ink having a second viscosity different from the first viscosity onto the surface of the water within the elongate member;

said first and second inks being capable of forming globules when contacting said surface;

applying a stream of air in a desired pattern to the surface of the water within the elongate member;

blowing the first and second litho oil inks with the air stream into a desired pattern on the surface of the water within the elongate member with the elongate member confining and defining the outermost distribution of the ink to the closed shape of the elongate members;

allowing the ink to float undisturbed by external forces on the surface of the water for a time lapse of about six to fourteen hours until the ink has formed into a desired globule pattern, whereby the ink forms a pattern in the water having a textured depth appearance;

after the time lapse, lowering the flexible sheet in a limp condition onto the surface of the water directly over the elongate member and over the ink with a central portion of the sheet being first lowered onto the water surface;

lifting the flexible sheet from the water surface to lift the litho oil pattern from the water onto the flexible sheet in a pattern corresponding to the pattern formed on the water by the blowing and time lapse steps, the outermost edge of the oil ink pattern on the sheet having the closed shape of the elongated member;

allowing the painting on the flexible sheet to at least partially dry;

applying a non-oil based ink to the flexible sheet within the closed shape of the painting to areas of the sheet on which ink is not present and using a sufficient quantity of ink to flow the ink to the edge of the oil pattern and stop the ink substantially without flowing ink onto the oil pattern; and allowing the non-oil-based ink and oil inks to dry to form a painting having the closed shape of the elongate member.

* * * * *